United States Patent [19]

Kronzer

[11] 4,240,807

[45] Dec. 23, 1980

[54] SUBSTRATE HAVING A THERMOPLASTIC BINDER COATING FOR USE IN FABRICATING ABRASIVE SHEETS AND ABRASIVE SHEETS MANUFACTURED THEREWITH

[75] Inventor: Frank J. Kronzer, Munising, Mich.

[73] Assignee: Kimberly-Clark Corporation, Neenah, Wis.

[21] Appl. No.: 646,386

[22] Filed: Jan. 2, 1976

[51] Int. Cl.[3] ..... C09K 3/14

[52] U.S. Cl. ..... 51/295; 51/298; 51/299; 428/514; 428/530; 428/475.8; 428/481; 428/479.6

[58] Field of Search ..... 51/293, 295, 297, 298, 51/299; 428/355, 511, 512, 514, 476, 530

[56] References Cited

U.S. PATENT DOCUMENTS

| | | | |
|---|---|---|---|
| 2,559,665 | 7/1951 | Ries et al. | 51/298 |
| 2,822,254 | 2/1958 | Goepfert et al. | 51/298 |
| 2,899,288 | 8/1959 | Barclay | 51/293 |
| 2,981,615 | 4/1961 | Baumgartner et al. | 51/299 |
| 3,135,590 | 6/1964 | Campbell et al. | 51/298 |
| 3,240,579 | 3/1966 | Ahlbrecht | 51/298 |
| 3,274,048 | 9/1966 | Armour et al. | 51/298 |
| 3,505,045 | 4/1970 | Klein | 51/298 |
| 3,619,150 | 11/1971 | Rinker et al. | 51/298 |
| 3,813,231 | 5/1974 | Gilbert et al. | 51/298 |

*Primary Examiner*—Donald J. Arnold

*Attorney, Agent, or Firm*—William D. Herrick; Wendell K. Fredericks

[57] ABSTRACT

A backing material for use in fabricating flexible abrasive sheets. The backing material comprises a flexible web substrate preferably of tough impregnated paper, having on one surface a heat-activatable binder coating which is a non-tacky solid at ambient temperatures and which coating when heated to a temperature insufficient to thermally degrade the substrate is softened and converted to a viscous fluid condition so that when abrasive grit is deposited on the softened coating and electrostatically aligned, the grit by virtue of its weight alone, i.e. by gravity, will sink into the coating to a depth which provides a firm bond with the coating after the heat is removed and the coating resets to its solid non-tacky state. The abrasive sheet products which result when the described backing material is used in the fabrication of such products is also defined.

16 Claims, No Drawings

SUBSTRATE HAVING A THERMOPLASTIC BINDER COATING FOR USE IN FABRICATING ABRASIVE SHEETS AND ABRASIVE SHEETS MANUFACTURED THEREWITH

BACKGROUND OF THE INVENTION

Coated abrasive sheet materials, including one type known in the trade as waterproof sandpaper, and another type known as dry finishing paper, have been used for metal and wood finishing for many years. The substrate used for the backing of the waterproof sandpaper is customarily a very porous, flexible paper impregnated with from about 15% to 40% of a synthetic resin or elastomer to provide toughness and durability, especially when wetted. Current production techniques require that this very porous paper be coated with a synthetic resin barrier coating to seal the surface before applying the adhesive or "make coat" which bonds the abrasive grains or grit to the substrate.

The substrate employed for dry finishing paper is much stiffer and non-porous and in such products the bonding adhesive coat is usually applied directly to the paper without first applying a barrier coating.

Adhesives used for bonding the grit to waterproof sandpaper include epoxy resins, epoxy esters, phenolic resins, and alkyd resins in suitable solvents. Bonding adhesives for dry finishing paper on the other hand are usually animal glues and water based synthetic resins.

In the conventional production of both kinds of paper, the bonding adhesive is dissolved or dispersed in a solvent or carrier and the mixture is then applied by a pressure coating nip to the continuous web substrate. The abrasive grit particles are then deposited on the moving web before the solvent or carrier is driven off, and while the adhesive is still fluid. The grit particles are usually oriented or aligned by electrostatic means to maximize abrasive or cutting properties. No external pressure is applied to the particles after deposition, as this tends to destroy the alignment of particles, while burying the particles in the backing, both of which are undesirable. After the solvent or carrier is driven off, the web carrying the adhesive and grit is passed through an oven which heats the material for times ranging from several minutes to several hours to cure the thermosetting resins usually employed as adhesives and to firmly bond the grit therein. Dry finishing paper adhesives usually do not require heat curing, although heat may be employed to drive off the fluid carrier.

After the grit is firmly bound to the backing, a "grain size" coating is applied over the layer of abrasive particles to complete the fabrication step. The grain size coating is usually a hard, thermosetting resin or animal glue which anchors the particles more firmly so that they remain aligned for maximum cutting ability.

It should be appreciated that as indicated above the making of abrasive paper is a slow, continuous process. Because the adhesive coating, particle deposition, drying and curing are carried out in a continuous process, many variables such as the solution viscosity, coating weight, grit deposition weight, web tension, drying rate and curing temperature must be controlled simultaneously. If not properly controlled, problems often arise such as curling and breaking of the moving web, excessive penetration of adhesive into the web, or too little bonding strength. Also, if the backing is pre-coated with a barrier coat prior to applying the grit bonding adhesive, poor adhesion between the barrier coating and adhesive coating is often encountered unless the two coatings are carefully formulated and tested. It is virtually impossible to supply an abrasive backing with a single barrier coating which is compatible with all the many types and variations of adhesives currently being employed by abrasive paper manufacturers. Thus barrier coatings are individually tailored to meet the individual requirements of the many abrasive manufacturing facilities in the world.

The recent emphasis on control of air pollution has complicated the situation further. Many abrasive manufacturers who in the past relied on solvent-based resins for making wet or dry abrasive paper are now being forced to use water-based systems to reduce such air pollution. This change necessitates extensive testing of new adhesive systems and the development of new barrier coatings. Although it may be possible to solve many of these problems with current techniques, the alternative proposed here, a backing with a heat-activatable adhesive pre-applied, provides an economical and efficient system whereby abrasive manufacturers can eliminate or minimize many of these problems.

Since in this preferred system, there is no need for the abrasive paper manufacturer to apply a separate adhesive prior to depositing the grit, the abrasive paper manufacturing operation is simplified considerably. In this system a simple means for heating the precoated backing material replaces the more complicated adhesive coating equipment. Problems such as curling and wrinkling of the moving web are thereby minimized. Air pollution which accompanies the use of solvent-based adhesives is also eliminated along with current problems with respect to poor adhesion between the adhesive coating and barrier coating, since these two coatings are replaced by a single heat-activatable adhesive coating preapplied by the backing paper supplier. While the cost of a raw materials used in preparing the backing material of this invention are increased slightly over conventional backing material, because the preferred water-based, heat-activatable adhesives applicable to this invention are more expensive than the barrier coatings currently used, and because the coating weights are in most instances greater than the barrier coating weights of current products, the other advantages discussed above, including the use of a single coat rather than double coat system contribute to make this invention attractive to abrasive paper manufacturers.

PRIOR ART

In the prior art, U.S. Pat. No. 3,230,672 of Jan. 25, 1966 to F. B. Anthon suggests the use of a latex, or other rubber or thermoplastic compound, as an adhesive coating in abrasive polishing sheets, which coating when heated becomes tacky and which when cooled is resilient or yielding. The preferred coating material in this patent is specified as being of the kind commonly used in pressure-sensitive tapes. The method described is to coat a substrate with the adhesive binder to impregnate and fill the interstices, then uniformly distribute abrasive grits onto the binder, and finally feed the coated substrate and applied grits through a pair of heated pressure rolls which softens the adhesive binder while simultaneously pressing the grits into the binder. While this process may be satisfactory in providing a polishing sheet in which a majority of the grits are oriented with their plane faces relatively flat as defined in the patent, the necessity for applying pressure to embed the grits is detrimental to the finished product if applied to waterproof sandpaper as disclosed herein because it tends to destroy the perpendicular alignment of the grit particles as is desired in such papers for maximum cutting power, while at the same time the pressure nip buries the grit too deeply into the backing, thereby destroying much of its abrasive effect. Embedment of the grit by gravity alone, which is possible by the judicious election of a heat-activatable adhesive as described herein, eliminates this disadvantage.

U.S. Pat. No. 2,899,288 of Aug. 11, 1959 to E. H. Barclay teaches the manufacture of an abrasive sheet using a thermoplastic cloth backing material capable of being converted to a temporary softened state when heated. Polyethylene, polyvinyl or polystyrene plastics are indicated as suitable. The backing material is heated to temporarily soften the cloth material. Heated or non-heated abrasive particles are applied to the top surface of the cloth while it is in its softened state, and the cloth carrying the applied particles is then passed through a pressure nip to simultaneously press the abrasive particles into the cloth while cooling the latter to return it to its original non-tacky state. As noted in the previous discussion the use of pressure to embed the particles is considered undesirable. Further, if the defined cloth backing were to be softened sufficiently to obtain embedment of the abrasive by the force of gravity alone as required in this invention, the cloth would clearly lose its integrity and be difficult or impossible to handle without supplementary support. Much of its strength would also be lost.

Another prior art patent which has some pertinence is U.S. Pat. No. 3,813,231 of May 28, 1974 to R. E. Gilbert et al. This also describes the use of a thermoplastic substrate and the embedment of abrasive grit therein. The thermoplastic substrate is a copolymer of ethylene and acrylic acid. However as taught in that patent, the substrate consists of a thick thermoplastic film alone and requires the embedment therein by the simultaneous use of heat and pressure. Again, as discussed previously, the latter is detrimental to the abrasive characteristics required in the products defined in this invention.

Canadian Pat. No. 776,116 of Jan. 16, 1968 to Francis B. Barthoff discloses an antiskid covering which is made by extruding a molten blend of mineral wax and a normally solid polyolefin onto a flexible backing sheet, depositing grit particles thereon, and passing the thus-coated sheet through a chilled pressure nip which simultaneously embeds the particles in the polymer blend and sets the polymer coating.

The wax-polyolefin blend is, of course, unsuitable for waterproof sandpapers and the embedment step taught in this patent is undesirable for reasons previously set forth.

SUMMARY OF THE INVENTION

This invention is directed to an improved type of backing material for flexible abrasive products such as waterproof sandpapers, as well as dry finishing papers. A unique feature of the backing material is that it is coated with an adhesive for securing abrasive grit thereto which adhesive in its normal state is not tacky and does not flow readily at ambient temperatures, but becomes a viscous liquid at elevated temperatures. The adhesive is characterized by its ability to be softened sufficiently at a temperature which does not degrade the paper substrate, and which in its softened state permits grit particles deposited therein to sink into the softened adhesive by virtue of their own weight. The coated backing material may be wound into rolls for storage and shipping without blocking. In the manufacture of abrasive paper using this coated substrate, the backing material is heated above the softening point of the adhesive to a point where the viscosity of the adhesive is reduced to a condition whereby when particles of abrasive grit are deposited on the backing and electrostatically aligned the particles will penetrate into the softened coating by their own weight and become bound therein and to the backing. No pressure other than the force of gravity on the particles is employed or desired. Depending on the operating speed, it may be necessary to maintain heat on the backing material at a temperature above the softening point of the adhesive for about 30 seconds after deposition and electrostatic alignment to obtain suitable penetration of the grit particles. After deposition and embedment when the backing is cooled or the source of heat removed, the adhesive hardens to its original state, and the abrasive particles are thus bound firmly therein. A final step in the fabrication of the finished abrasive sheet product is to apply a conventional resin coating, or grain size over the abrasive particles as is done with conventional abrasive papers.

The substrate to which the adhesive is applied is a flexible sheet material, preferably a resin or latex-impregnated paper, which must not soften or degrade at the temperatures employed to soften the adhesive. The amount of adhesive applied to the backing is adjusted so that abrasive particles of the desired size will become only partially embedded in the adhesive but not be buried in it.

The process for manufacturing abrasive products using the coated backing material of this invention is easily adapted to the continuous processes currently being used. For example, the adhesive coating equipment in the conventional process is replaced by a means for heating the moving web of coated backing material. An infrared heat source, banks of electric elements, gas panels or a heated metal cylinder may be employed as the heating means. Preferably, a second heating means for heating the web for several seconds after the grit has been deposited in the softened coating is also provided. Another option is to heat the grit particles before they are deposited. This speeds up the embedment process and requires a lesser amount of heat to maintain the viscous condition of the adhesive during and after application of the grit.

DETAILED DESCRIPTION OF THE PREFERRED EMBODIMENT OF THE INVENTION

In carrying out the invention, two types of base paper or substrate for the backing are preferred. The first, which is commonly employed for waterproof sandpapers, is a highly porous kraft paper containing from 15 to 40% nitrile rubber or an acrylic elastomer. Pigments may also be added. The preferred basis weight of the paper is from about 70 to about 200 grams per square meter and the preferred Gurly porosity is less than 10 seconds per 100 cc of air for a single sheet. The second type of paper which is commonly employed for dry finishing papers is a more highly refined kraft paper containing filler and dyes or pigments if desired and from 0 to 15% of a nitrile rubber or an acrylic elastomer. The basis weight of the latter paper is from about 65 to about 200 grams per square meter and the single sheet Gurley porosity is greater than 10 seconds per 100 cc of air. Functional additives which may be useful in this type of paper include sizing agents and starch. It is understood that the base papers used in wet finishing have the impregnant cured or thermoset to the extent that the impregnant will impart sufficient wet strength for such uses.

For the adhesive coating, a variety of waterbased, heat-sensitive adhesive systems have been tested and many of these have been found suitable. A number of others have not been found suitable and are specifically excluded. Examples of adhesives which are not suitable are: (1) Polyvinyl chloride latexes blended with various softer polymers such as acrylic elastomers or with conventional plasticizers. These do not soften sufficiently below 220° C. to permit abrasive particles to sink therein by gravity alone and thus require too high a temperature to be practical. (2) SBR, ABS, polyvinylacetate, and most acrylic latexes are not suitable for the same reason. (3) Wax, polyethylene, and low molecular weight ethylene-organic acid copolymer dispersions or latexes adhere poorly to the paper and/or the silicon carbide grits commonly employed in the preferred abrasive papers and are unsuitable for those reasons.

Among the useful adhesives, several of the ethylene-vinylacetate copolymer latexes and ionomer resin dispersions such as ELVAX® D manufactured by DuPont and described in DuPont Technical Bulletin A-86826 have been found suitable. These adhesives may also be blended with nitrile rubber or acrylic latexes to give coatings which have improved flexibility and provide improved adhesion to the paper substrates especially when the latter are impregnated with the same latexes. Blending these ethylene-vinylacetate copolymer latexes or ionomer latexes with polyterpene emulsions provides such blends with very low softening temperatures which are desirable, and while these blends are useful the adhesion to the paper is not as good as with the blends with acrylic or nitrile rubber latexes. Relatively high molecular weight ethylene-acrylic acid copolymer dispersions such as PCX 300, an alkali dispersible ethylene copolymer manufactured by Union Carbide and described in their Technical Bulletin F-42958-A, when blended with acrylic, nitrile rubber, or polyterpene latexes also are suitable. Blends of a novalac resin such as DUREZ® by Hooker Chemical with ACRYSOL® WS-32, a Rohm & Haas polymeric acrylic resin in aqueous dispersion, also are suitable.

Other useful polymers include polyvinyl butyral, ethylene-ethyle acrylate copolymers and linear aliphatic polyamides and polyesters. Many other types of polymers or blends with properties similar to those given above are, of course, possible. The required characteristic is that the selected adheisve be a non-tacky solid at ambient temperature, and when heated to a temperature low enough so as not to degrade cellulose substrates are softened sufficiently to permit abrasive particles to embed themselves therein by gravity alone. The following examples illustrate various embodiments of the invention:

EXAMPLE I

The paper substrate in this example was a very porous kraft paper impregnated with 33% nitrile rubber by weight and weighing about 80 grams per square meter. The impregnated paper was coated with a blend containing 33% dry weight of the above-mentioned ACRYSOL® WS-32 polymeric acrylic latex and 67% dry weight of the above-mentioned ionomer resin dispersion known as ELVAX® D-1265. The total percent solids of the coating mixture was 47%. The applied coating was metered to a dry coating weight of 22 grams per square meter by using a wire-wound "Mayer" rod as is common in the trade. The coating was then dried and a sample $8\frac{1}{2}\times 11''$ sheet was placed coated side down against an uncoated sheet of the same type of paper. The sheets were then placed together at ambient temperature in a hydraulic press and the pressure was increased to 12 lbs. per square inch. It was found that the sheets were not bound together after 16 hours and could be separated with very little sticking after removal from the press.

A sample sheet of the coated paper was then placed coated side up on a hotplate until the surface temperature of the paper was between 150° and 220° C. Then #200 silicon carbide grit which was pre-heated to 250° C. was poured in a line at one edge of the sheet. The sheet was then raised quickly on the same edge to distribute the silicon carbide on the sample. As is well known in the trade, this method of grit application is employed to simulate the continuous application used in abrasive paper manufacture and is commonly used to make hand samples. After shaking the excess grit particles off, a uniform deposit of silicon carbide weighing 70 grams per square meter remained bonded to the sample. Although the particles could be removed by scraping with a sharp instrument, they were bound firmly enough to allow further processing with a size coating without causing any significant loss of silicon carbide.

The size coating, which comprised a thermosetting phenolic resin solution, was applied to the sample over the silicon carbide; again using a wirewound Mayer rod to apply a dry size coating of about 33 grams per square meter. The sample was then placed in an oven at 107° C. for six hours to cure the phenolic resin. It was then cut into two $5\times 6''$ pieces for testing. One sample was soaked in water for one hour for wet testing and the other was tested dry. Adhesion and peel resistance were tested by rolling the corners of the samples ten times between the thumb and forefinger. There was no peeling or loss of silicon carbide from either sample. A steel rod $\frac{1}{4}''$ in diameter was abraded with the wet sample until the surface of the sample became smooth due to loading with steel and corrosion. The deposit of steel was washed from the sample with water and there was no evidence of any loss of silicon carbide particles. The process of abrading the steel rod and washing the sample was repeated 10 times, until a 2-foot section of the rod was free of corrosion, and there still was no evidence of peeling of adhesive or loss of silicon carbide from the sample.

EXAMPLE II

In this example the substrate for the backing was a kraft paper impregnated with inorganic filler and 10% by weight of a polymeric acrylic elastomer. The paper was coated with a blend containing DUREZ® 12686 novalac resin, a phenolic resin supplied by Hooker Chemical and emulsified in water and methyl ethyl ketone, and the previously mentioned ACRYSOL® WS-32 acrylic latex. The ratio of phenolic resin to acrylic polymer in the blend was 1:0.9 and the total percent solids of the blend was 35%. The coating was applied with a Mayer rod to give a dry coating weight of 15 grams per square meter. Three hundred twenty mesh silicon carbide was heated to 250° C. and applied to the paper, which was placed coated side upon a hotplate at a temperature between 150° and 200° C. The silicon carbide was distributed evenly on the backing by lifting one edge quickly as in the previous example and the sample was then placed in an oven set at 165° C. for 30 seconds. After removing the excess, the weight of silicon carbide deposited was found to be 33 grams per square meter. The sample was then size coated with a blend of the same composition used for the adhesive coating. After drying the size coating, the sample was placed in an oven at 165° C. for five minutes to cure the coatings. The silicon carbide was found to be very strongly bound to the backing and there was no significant loss of particles when the sample was used to abrade metal or wood.

While in the above examples the abrasive grit was pre-heated before being applied in order to accelerate embedment, further tests found this preheating was not necessary to obtain satisfactory results. However, in the latter event the coating with the grit applied is preferably held at an elevated temperature for a somewhat longer period to insure satisfactory embedment and bonding of the particles.

While latex-impregnated paper is the preferred substrate for the abrasive backing material of this invention, other flexible substrates may be used. The requirements of the substrate itself are not too stringent. Paper made primarily from chemical wood pulp fibers is preferred because of ready availability and low cost. Highly porous kraft paper containing a nitrile rubber or an acrylic elastomer similar to the waterproof sandpaper backings currently used has given the best results in laboratory tests. More highly refined, much less porous paper similar to the dry finishing paper in current use has also given satisfactory results for use in fabricating dry finishing papers. Other cellulosic fibers such as cotton or rayon may be used alone or in admixture with wood pulp fiber, as well as synthetic and glass fibers. When wood pulp or other cellulosic fibers are used in the substrate, the selected adhesive must soften sufficiently at temperatures below 220° C. since at this temperature the fibers in such paper begin to char rapidly. Adhesive coatings requiring higher temperatures to bond the grit particles could be employed in combination with more heat resistant backings. In general the substrate should be flexible enough to be capable of being wound into rolls for storage and shipping. The substrate should have enough thermal stability to support the adhesive coating while the rolls are unwound and while the material is heated above the softening point of the adhesive. The substrate should also have a relatively closed surface so that the abrasive grit particles will penetrate only through the softened adhesive coating and not enter the substrate itself.

The heat-activatable adhesive may be applied in various weights to accommodate various size grit particles. In general, it is preferred that the adhesive have the following characteristics:

1. For application to the substrate it may be in the form of a solution in a suitable solvent, as an emulsion or latex in water, or as a molten plastic material.

2. The adhesive coating in its applied state after the solvent or carrier has been driven off, or after the molten coating has cooled and solidified should be non-tacky so that the backing material may be wound into rolls and stored without blocking or sticking together in order that the rolls may be unwound without damaging the material. It should remain non-tacky through the normal range of ambient temperatures encountered in normal handling, i.e., at least up to about 35° C.

3. When heated to a temperature high enough to soften the adhesive, but low enough so as not to degrade or soften the backing material, the adhesive coating should become a viscous liquid which will permit particles deposited thereon to embed themselves by gravity alone. External pressure to insure embedment bonding of the particles to the backing is to be avoided. In some cases the coated backing may be maintained above the softening point of the adhesive for approximately 30 seconds or so to insure adequate wetting and embedment of the particles by the softened adhesive.

4. The softened adhesive should be capable of hardening to its original state while the abrasive particles remain bonded to the backing at least well enough to permit application of a conventional size coating without removing any significant amount of the embedded grit particles from the backing.

5. The adhesive coating should be a tough, flexible, polar material which adheres well to the backing and the abrasive particles and does not peel away from the backing when the finished abrasive product is bent and deformed in use. Those mentioned earlier in the specification as suitable meet this requirement.

6. An optional feature of the adhesive coating is that it may be one which polymerizes further or crosslinks upon extended aging or at elevated temperatures, while retaining the essential characteristics given above. The additional polymerization or crosslinking strengthens and hardens the adhesive.

While the specific examples were prepared by a batch process, it has been demonstrated that substrates of the type defined herein are readily adaptable to the apparatus now employed for the continuous production of abrasive papers now commonly used by leading manufacturers. All that needs to be done to adapt this paper to existing abrasive manufacturing systems is to replace the present adhesive coating sections with a heating section and after application of the grit to provide for additional heat to permit full embedment, followed by a conventional or accelerated cooling run.

What is claimed is:

1. A coated backing material for use in fabricating flexible abrasive sheets, said backing material comprising a flexible web substrate having on one surface a thermoplastic adhesive coating comprised at least in part of a polymeric latex, which coating is in a non-tacky solidified condition at ambient temperatures and which coating when heated to a temperature in the range of 150° C. to 220° C. is softened to a viscous fluid condition, said fluid condition being characterized by the fact that when abrasive grit particles are deposited on the softened coating, gravity forces alone will permit the grit particles to sink into said softened coating to the extent that said particles will become embedded therein while said coating is in said heat-softened condition, and remain firmly bonded therein after the heat is removed and the coating resolidified by cooling.

2. The backing material of claim 1 wherein said substrate is a paper web impregnated with a synthetic resin which does not soften or degrade in said temperature range.

3. The backing material of claim 1 wherein said substrate is a highly porous kraft paper impregnated with a synthetic elastomer in the amount of from about 15% to 40% by weight, has a basis weight of from about 70 to about 200 grams per square meter, and has a Gurley porosity of less than 10 seconds per 100 cc of air.

4. The backing material of claim 1 wherein said substrate is a highly refined kraft paper having a basis weight of from about 65 to about 200 grams per square meter and a Gurley porosity greater than 10 seconds per 100 cc of air.

5. The backing material of claim 4 wherein said paper contains up to about 15% of a synthetic elastomer selected from the group consisting of nitrile rubber and acrylic elastomers.

6. The backing material of claim 1 wherein said substrate is a paper sheet comprised primarily of cellulosic fibers and the limit to which the temperature may be raised to soften the adhesive without degrading the substrate is 220° C.

7. The backing material of claim 1 wherein said coating is a blend of a polymeric acrylic latex and an ionomer resin dispersion.

8. The backing material of claim 7 wherein the acrylic latex comprises 33% by weight and the ionomer resin 67% by weight of said blend.

9. The backing material of claim 8 wherein said substrate is a porous kraft paper impregnated with about 33% nitrile rubber by weight, has a basis weight of about 80 grams per square meter and has a Gurley porosity of less than 10 seconds per 100 cc of air.

10. The backing material of claim 1 wherein said coating is a blend of phenolic resin and a polymeric acrylic latex.

11. The backing material of claim 10 wherein the ratio of phenolic resin to acrylic latex is 1 to 0.9.

12. A flexible abrasive sheet comprising the backing material of claim 1 wherein said coating has embedded in its surface a layer of uniformly distributed abrasive grit particles, and said layer has applied thereover a grain size coating.

13. An abrasive finishing paper comprising the backing material of claim 2 wherein said coating has embedded in its surface a layer of uniformly distributed abrasive grit particles, and said layer has applied thereover a grain size coating.

14. A waterproof sandpaper comprising the backing material of claim 3 wherein said coating has embedded in its surface a layer of uniformly distributed abrasive grit particles and said layer has applied thereover a grain size coating.

15. A dry finishing paper comprising the backing material of claim 4 wherein said coating has embedded in its surface a layer of uniformly distributed abrasive grit particles and said layer has applied thereover a grain size coating.

16. The backing material of claim 1 wherein the coating is selected from the group consisting of polyvinyl butyral, ethylene-ethyl acrylate copolymers, linear aliphatic polyamides and polyesters, blends of ethylene-vinylacetate copolymer latexes and ionomer resin dispersions, blends of high molecular weight ethylene-acrylic acid copolymer dispersions with acrylic nitrile rubber or polyterpene latexes, and blends of novolac resins with polymeric acrylic resins.

* * * * *